US006588590B1

(12) United States Patent
Wang

(10) Patent No.: US 6,588,590 B1
(45) Date of Patent: Jul. 8, 2003

(54) COMBINATION STORAGE BOX

(76) Inventor: Wen-Tsan Wang, PO Box 82-144, Taipei (TW)

( * ) Notice: Subject to any disclaimer, the term of this patent is extended or adjusted under 35 U.S.C. 154(b) by 0 days.

(21) Appl. No.: 10/102,717

(22) Filed: Mar. 22, 2002

(51) Int. Cl.[7] ..... B65D 85/00
(52) U.S. Cl. ..... 206/425; 312/184
(58) Field of Search ..... 206/214, 215, 206/425; 220/9.4; 229/67.1, 67.2, 164; 312/183, 184

(56) References Cited

U.S. PATENT DOCUMENTS 3,938,870 A * 2/1976 Guest et al. ..... 312/184
5,193,701 A * 3/1993 Bush et al. ..... 206/425
5,494,161 A * 2/1996 Herbst ..... 206/425
5,570,792 A * 11/1996 Huang ..... 312/184
5,842,570 A * 12/1998 Turnbull ..... 206/425
6,352,157 B1 * 3/2002 Srinivasan ..... 206/425

* cited by examiner

*Primary Examiner*—Luan K. Bui
(74) *Attorney, Agent, or Firm*—Leong C. Lei

(57) ABSTRACT

A combination storage box is constructed to include a collapsible box body, a support frame formed of two rectangular open frames and four sleeves and mounted in the collapsible box body to support the collapsible box body in shape, the rectangular open frames each having four plug rods in four corners, the sleeves being respectively sleeved onto the plug rods of the rectangular open frames to hold the rectangular open frames together, the collapsible box body having four folding flaps respectively extended along the topmost edges of four sides thereof and hook and loop materials fixedly provided at an inner side of each folding flap and adapted to secure the folding flaps to the support frame.

4 Claims, 6 Drawing Sheets

COMBINATION STORAGE BOX

BACKGROUND OF THE INVENTION

1. Field of the Invention

The present invention relates to storage boxes and, more particularly, to a combination storage box, which is detachable and, can easily quickly be set up for service.

2. Description of the Related Art

A variety of combination storage boxes are commercially available. Conventional combination storage boxes are commonly comprised of a collapsible fabric box body, hard support panels respectively mounted in the collapsible fabric box body, and fastening means adapted to secure the hard support panels to the collapsible fabric box body. This conventional design of combination storage box is not satisfactory in function due to the following drawbacks. 1. The hard support panels greatly increase the manufacturing cost of the combination storage box. 2. This design of combination storage box is not suitable for use as a file rack for holding hanging files.

SUMMARY OF THE INVENTION

The present invention has been accomplished under the circumstances in view. It is one object of the present invention to provide a combination storage box, which is inexpensive to manufacture and easy to install. It is another object of the present invention to provide a combination storage box, which can be used as a file rack for holding hanging files. According to one aspect of the present invention, the combination storage box comprises a collapsible box body, a support frame formed of two rectangular open frames and four sleeves and mounted in the collapsible box body to support the collapsible box body in shape, the rectangular open frames each having four plug rods in four corners, the sleeves being respectively sleeved onto the plug rods of the rectangular open frames to hold the rectangular open frames together, the collapsible box body having four folding flaps respectively extended along the topmost edges of four sides thereof and hook and loop materials fixedly provided at an inner side of each folding flap and adapted to secure the folding flaps to the support frame. According to another aspect of the present invention, the rectangular open frames are disposed at different elevations, and the top rectangular open frame has two transverse frame bars disposed at two sides and two longitudinal rods bilaterally connected between the transverse frame bars for holding hanging files.

DETAILED DESCRIPTION OF THE PREFERRED EMBODIMENT

Figure 1:
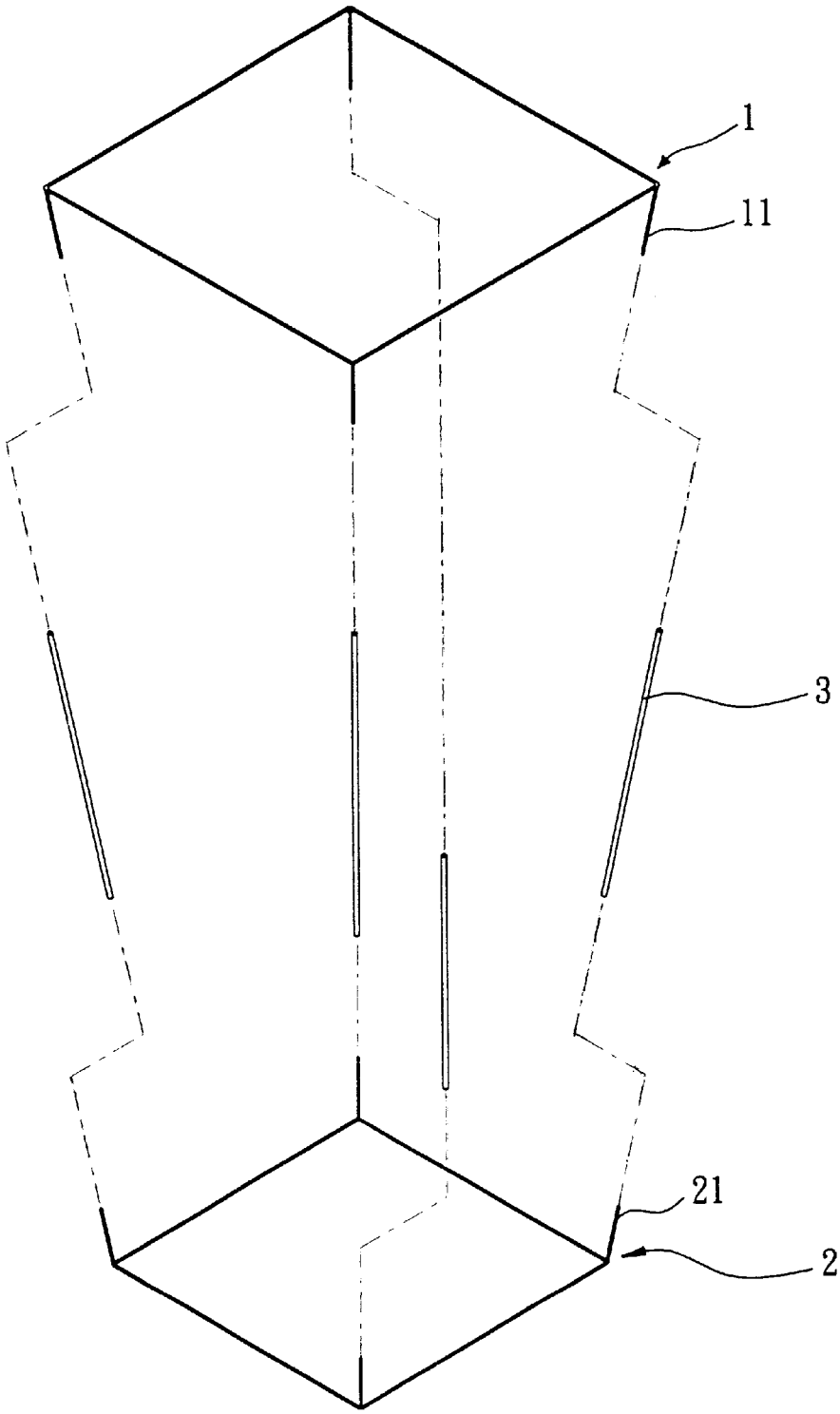
FIG. 1 is an exploded view of a support frame for a combination storage box according to the present invention.
Figure 2:
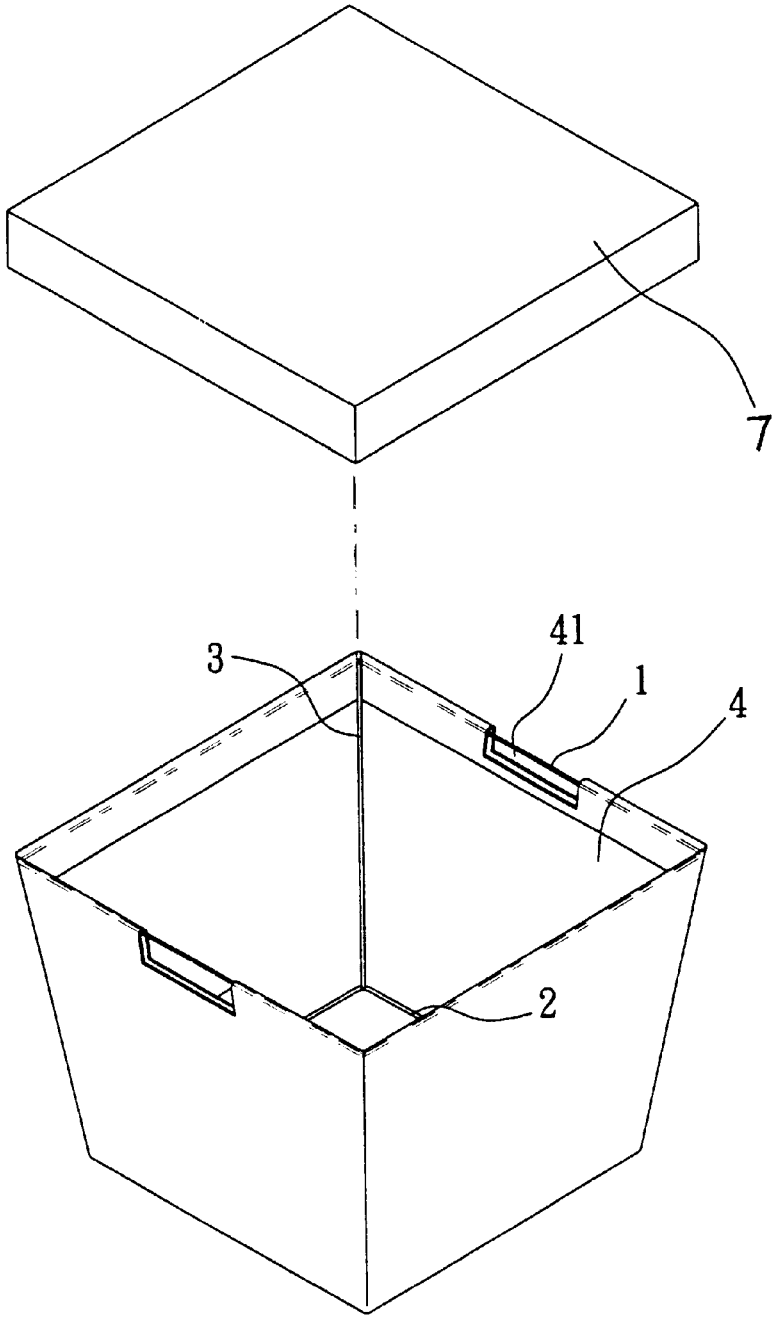
FIG. 2 is a perspective view of a combination storage box according to the present invention
Figure 4:
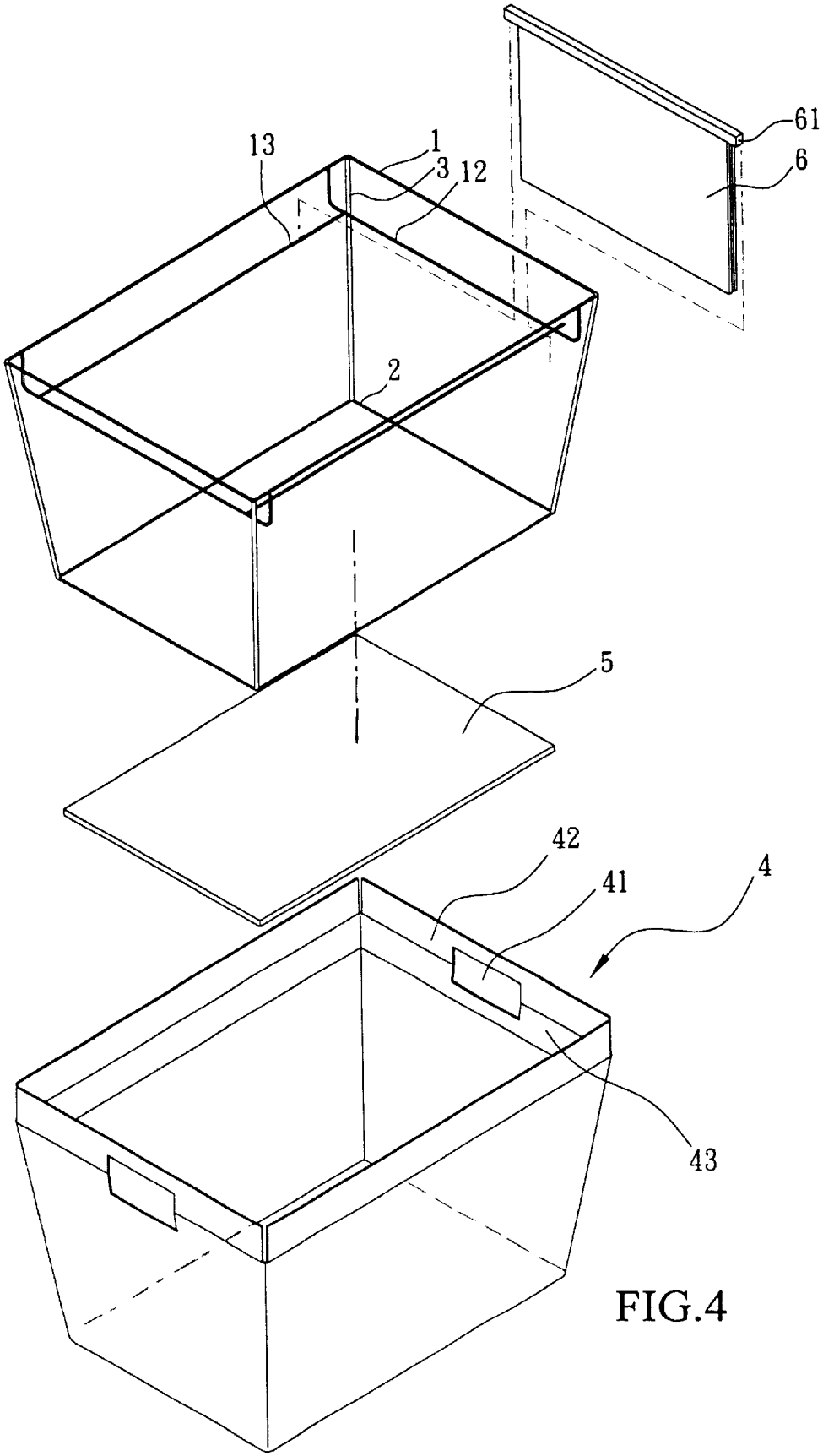
FIG. 4 is an exploded view of the alternate form of the combination storage box according to the present invention.

Referring to FIGS. 1 and 2, a combination storage box in accordance with the present invention is shown comprised of a collapsible box body 4, a hard planar bottom plate 5 mounted in the collapsible box body 4 and closely attached to the bottom panel of the collapsible box body 4, and a support frame mounted in the collapsible box body 4 on the hard planar bottom plate 5 to support the collapsible box body 4 in shape for holding things. The support frame is formed of a top frame 1, a bottom frame 2, and four sleeves 3. The top frame 1 is a rectangular open frame (formed of four wire rods welded to one another at four sides), having four plug rods 11 obliquely downwardly disposed in the four corners. The bottom frame 2 is a rectangular open frame (formed of four wire rods welded to one another at four sides), having four plug rods 21 obliquely upwardly disposed in the four corners. The four sleeves 3 are respectively sleeved onto the plug rods 11 of the top frame 1 and the plug rods 21 of the bottom frame 2 to hold the top frame 1 and the bottom frame 2 together. Preferably, the top frame 1 is relatively greater than the bottom frame 2 so that the support frame has a conical shape with a relatively wider top side and narrower bottom side. The collapsible box body 4 comprises four folding flaps 42 respectively extended along the topmost edges of the four sides thereof, hook and loop materials 43 fixedly provided at the inner side of each of the folding flaps 42, and two hand holes 41 at two opposite sides (see also FIG. 4). After insertion of the hard planar bottom plate 5 and the support frame into the collapsible box body 4, the folding flaps 42 are respectively folded inwards and secured to the top frame 1 by means of fastened up the hook and loop materials 43. When installed, a part of the top frame 1 is exposed to the hand holes 41, serving as handle means for the holding of the hand. Further, a top cover 7 may be used to close the combination storage box.

Figure 3:
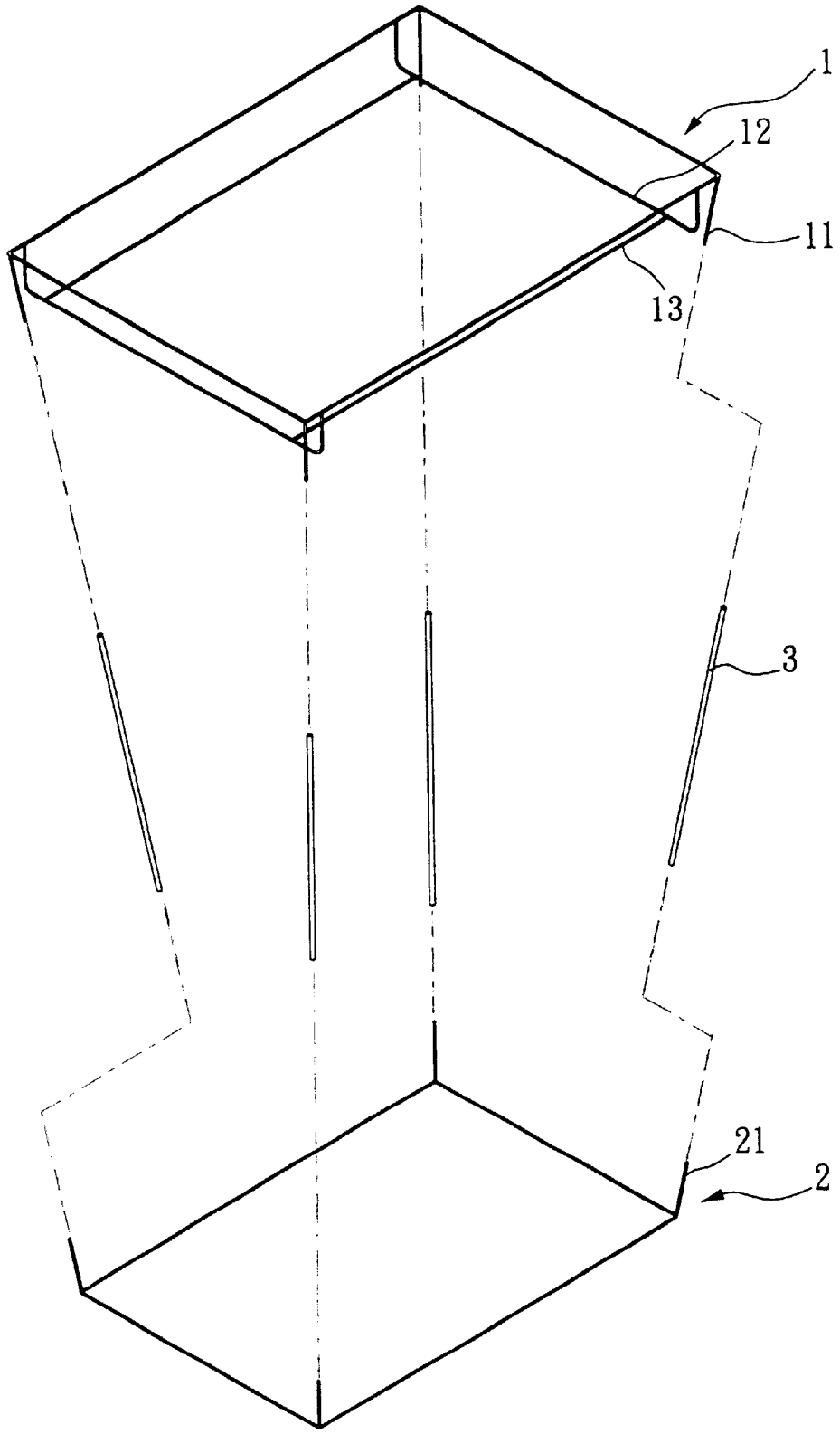
FIG. 3 is an exploded view of an alternate form of the support frame for the combination storage box according to the present invention.
Figure 5:
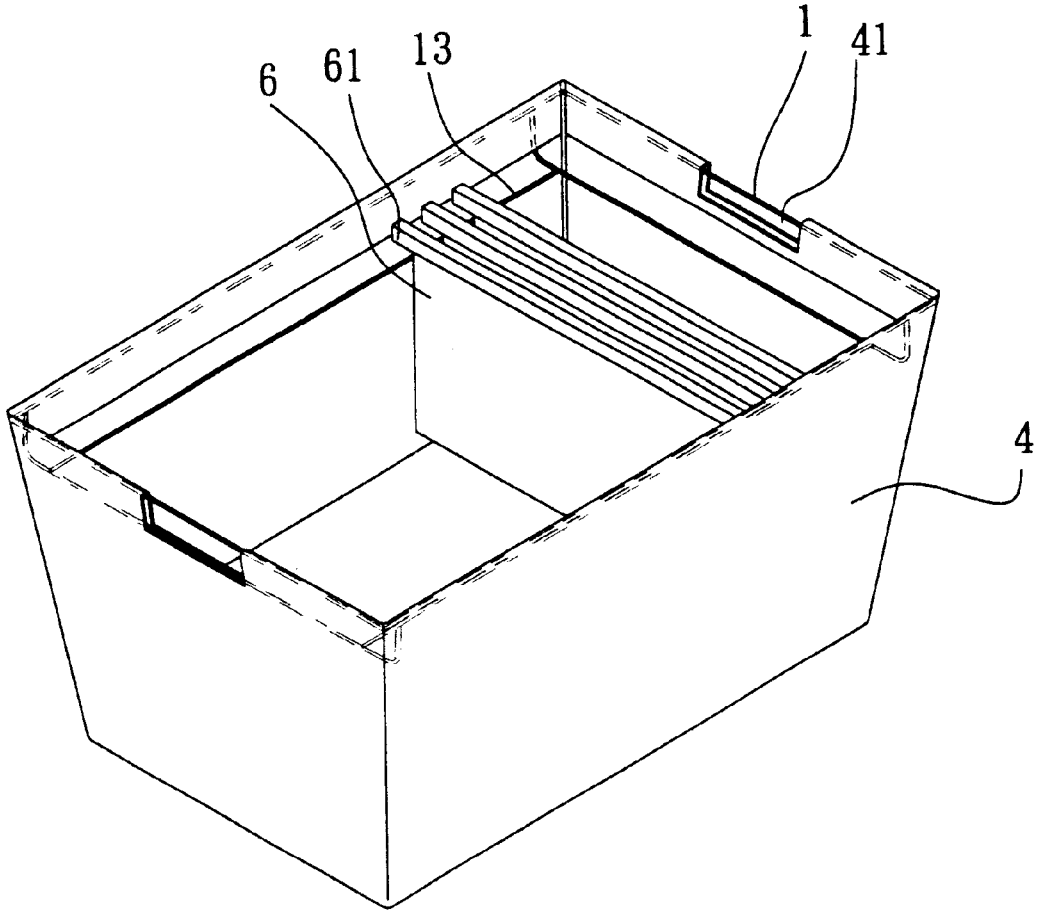
FIG. 5 is a perspective view of the alternate form of the combination storage box according to the present invention, showing hanging files installed in the combination storage box.

FIG. 3 shows an alternate form of the support frame for the combination storage box. According to this alternate form, the support frame is comprised of a top frame 1, a bottom frame 2, and four sleeves 3. The top frame 1 is a rectangular open frame having four plug rods 11 obliquely disposed in the four corners. The bottom frame 2 is a rectangular open frame having four plug rods 21 obliquely disposed in the four corners. The sleeves 3 are respectively sleeved onto the plug rods 11 of the top frame 1 and the plug rods 21 of the bottom frame 2 to secure the top frame 1 and the bottom frame 2 together. The top frame 1 further comprises two transverse frame bars 12 disposed at two opposite sides, and two longitudinal hanging rods 13 bilaterally connected between the transverse frame bars 12 for hanging files 6. After installation of the hard planar bottom plate 5 and the support frame in the collapsible box body 4 (see FIGS. 4 and 5), the hooked rods 61 of hanging files 6 are respectively hung on the hanging rods 13 in the combination storage box (see FIG. 5).

Figure 6:
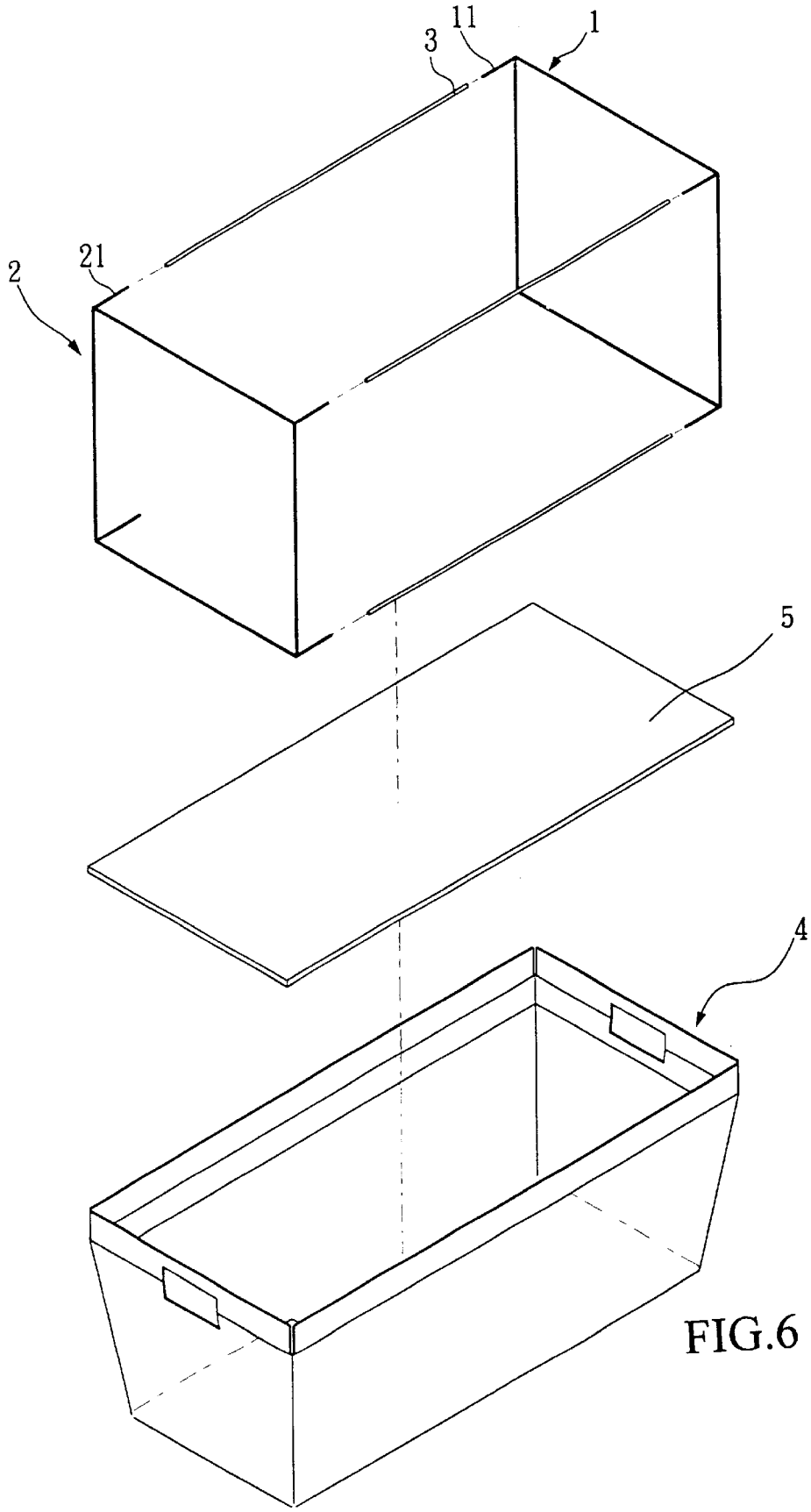
FIG. 6 is an exploded view of another alternate form of the combination storage box according to the present invention.

FIG. 6 shows another alternate form of the present invention. According to this alternate form, the combination storage box is comprised of a collapsible box body 4, a hard planar bottom plate 5 mounted in the collapsible box body 4 and closely attached to the bottom panel of the collapsible box body 4, and a support frame mounted in the collapsible box body 4 on the hard planar bottom plate 5 to support the collapsible box body 4 in shape for holding things. The top frame 1 and the bottom frame 2 have equal size, and are disposed facing each other, keeping the plug rods 11 and 21 in horizontal. The sleeves horizontally disposed in four corners at different elevations, and respectively sleeved onto the plug rods 11 of the top frame 1 and the plug rods 21 of the bottom frame 2.

A prototype of combination storage box has been constructed with the features of the annexed drawings of FIGS. 1 through 6. The combination storage box functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A combination storage box comprising a collapsible box body, a hard planar bottom plate mounted in said collapsible box body, and a support frame mounted in said collapsible box body on said hard planar bottom plate to support said collapsible box body in shape, wherein said support frame comprises a first rectangular open frame, said first rectangular open frame having four plug rods in four corners thereof, a second rectangular open frame, said second rectangular open frame having four plug rods in four corners thereof, and four sleeves respectively sleeved onto the plug rods of said first rectangular open frame and the plug rods of said second rectangular open frame to hold said first rectangular open frame and said bottom frame together; said collapsible box body comprises four folding flaps respectively extended along the topmost edges of four sides thereof and respectively folded inwards and attached to said support frame, and hook and loop materials fixedly provided at an inner side of each of said folding flaps and adapted to secure said folding flaps to said support frame.

2. The combination storage box as claimed in claim 1, wherein said first rectangular open frame is disposed above said second rectangular open frame, having two transverse frame bars disposed at two sides and two longitudinal rods bilaterally connected between said transverse frame bars for holding hanging files.

3. The combination storage box as claimed in claim 1, wherein the plug rods of said first rectangular open frame are downwardly obliquely extended from the four corners of said first rectangular open frame; the plug rods of said second rectangular open frame are upwardly obliquely extended from the four corners of said second rectangular open frame and respectively connected to the plug rods of said first rectangular open frame.

4. The combination storage box as claimed in claim 1, wherein said first rectangular open frame and said second rectangular open frame have equal size and are disposed at two sides, keeping the respective plug rods in horizontal, and said sleeves are disposed in horizontal and respectively sleeved onto the plug rods of said first rectangular open frame and said second rectangular open frame.

* * * * *